United States Patent [19]

Stanzani et al.

[11] Patent Number: 4,854,829

[45] Date of Patent: Aug. 8, 1989

[54] STRUCTURE FOR MOTOR-COMPRESSOR UNITS USED WITH REFRIGERANT FLUIDS

[76] Inventors: Franco Stanzani, Via dei Tigli, 66, Ariccia (Roma), Italy, 00040; Sandro Stanzani, Piazzale Roberto Ardigò, 30, Roma, Italy, 00142

[21] Appl. No.: 166,110

[22] Filed: Mar. 10, 1988

[30] Foreign Application Priority Data

Mar. 16, 1987 [IT] Italy ..... 47731 A/87

[51] Int. Cl.[4] ..... F04B 39/14

[52] U.S. Cl. ..... 417/360; 417/367; 417/369

[58] Field of Search ..... 417/360, 369, 367, 366, 417/372, 313, 243, 415, 420, 902, 423 H, 423 S, 370; 62/298; 165/916, 167

[56] References Cited

U.S. PATENT DOCUMENTS

| | | | |
|---|---|---|---|
| 2,041,128 | 5/1936 | Hirche | 417/415 |
| 2,556,435 | 6/1951 | Moehrl et al. | 417/367 |
| 2,969,908 | 1/1961 | Dallenbach | 417/372 |
| 2,999,629 | 9/1961 | Soumerai | 417/415 |
| 3,222,555 | 12/1965 | Snoberger | 417/422 |
| 4,052,765 | 10/1977 | Gühne | 15/344 |
| 4,349,322 | 9/1982 | Stahle | 417/370 |
| 4,569,645 | 2/1986 | Asami | 418/63 |
| 4,742,866 | 5/1988 | Yamanaka et al. | 165/38 |

*Primary Examiner*—Carlton R. Croyle
*Assistant Examiner*—Robert N. Blackmon
*Attorney, Agent, or Firm*—Thomas R. Vigil

[57] ABSTRACT

The structure consists in a casing, the interior of which affords a chamber for the compressor and a housing for the motor, separated in fluid-tight fashion by a bulkhead through which a sealed passage is offered to the shaft of the compressor; such a casing also exhibits a set of galleries arranged peripherally around the housing, along which the refrigerant is able to flow and thus keep the motor at a given temperature.

10 Claims, 2 Drawing Sheets

STRUCTURE FOR MOTOR-COMPRESSOR UNITS USED WITH REFRIGERANT FLUIDS

BACKGROUND OF THE INVENTION

The invention disclosed relates to a structure for motor-compressors used with refrigerant fluids.

The component of greatest importance in the majority of refrigeration systems, or conditioning systems generally, is the motor-compressor unit by which the compression of the refrigerant gas is effected.

Such units fall substantially into two different types, one of open design, the other sealed.

The first consists essentially in a compressor, and a motor which drives the compressor, which are embodied as self-contained units and interconnected by a drive coupling. The main advantage of this type of motor-compressor is the possibility of adopting different types of motor to drive the compressor and of gaining easy access to the motor for servicing.

The main drawback, on the other hand, is that of insulating the compressor, since this requires the creation of a hermetic seal around a moving part.

Another disadvantage of this type of compressor is the limited cooling of the motor, which in this instance is externally ventilated, or cooled by a fluid other than that in the refrigeration system.

Sealed motor-compressors, by contrast, are designed such that the compressor affords a housing for the motor, which is therefore encapsulated in a fluid-tight container and cooled by the refrigerant circulating in the system.

Motor-compressors of this type therefore present no problems whatever in terms of creating a hermetic seal; the seal is effected on a static component, since the motor is housed internally of an already fluid-tight container.

There is increased preference for the sealed motor-compressor over the open design type, thanks to the development of new refrigerant fluids, and to the more compact dimensions of such units.

A reduction in the bulk of these sealed units is made possible by virtue of the aforementioned fact that the drive motor is cooled by the self-same refrigerant fluid, which permits of obtaining a practically constant, limited running temperature.

Nonetheless, the fact that the motor is cooled by the refrigerant can occasion additional, serious drawbacks, which arise in the event of malfunction occurring in the motor-compressor. More exactly, overheating in the windings of the electric motor can cause fragments of scorched insulation to be shed, thus contaminating the refrigeration circuit. The high temperatures generated in an overheating electric motor also engender a conversion of the refrigerant and lubricating oil into acids of strong concentration, which increase contamination in the refrigeration circuit.

In smaller machines, such as those for domestic use, this drawback is overcome by replacing the entire refrigeration system, the cost of which is far less than that of effecting repairs. In larger installations, it is impossible even to contemplate a full replacement of the refrigeration system, indeed of the motor-compressor alone, for obvious reasons of cost.

In large refrigeration systems, replacement of the electric motor only is feasible, provided that the refrigeration circuit has not been seriously contaminated, but involves a certain number of operations: the motor-compressor must be drained of refrigerant and the motor removed; the air must be bled off, and the refrigeration circuit must be force dried before it can ultimately be refilled and operated.

The cost of such operations, which is high in any event, becomes even higher due to the fact that it is practically impossible to re-use refrigerant drained from the motor-compressor.

Besides giving rise to problems with servicing and repairs, the difficulty of gaining access to the motor obliges manufacturers and wholesalers to run excessively capacious warehousing facilities in order that the different requirements of users can all be met. In other words, it becomes necessary to maintain a stock of motor-compressor units having different drive motor specifications, in particular, dissimilar in terms of power consumption and power supply -i.e. input voltage and a.c. or d.c. current. In effect, it would be unthinkable to hold stocks of a given number of motor-compressors having certain specifications, and in the light of the foregoing, of a given number of motors with other mechanical or elctrical specifications serving simply to replace those already fitted.

In an attempt to overcome the drawbacks of the sealed motor-compressor unit, while maintaining its advantages substantially intact, the idea has been put forward of accommodating the compressor and the motor in respective compartments that are sealed off hermetically one from the other by a bulkhead which spans the inside of the casing that houses the unit. An example of this expedient is disclosed in Italian Pat. No. 194436, owned by the same applicant.

It has been discovered, nonetheless, that whilst the adoption of this expedient is able to eliminate problems connected with the use of the conventional sealed motor-compressor unit, total isolation of the motor from the compressor and refrigeration system gives rise to fresh difficulties, as regards the attainment of efficient cooling for the motor, and of a degree of insulation that will neither tend to jeopardize the efficiency of the unit, nor result in loss of motor power.

Given that the electric motors most widely used are oil-cooled, an expedient that makes for smoother running of the motor, the option exists of fitting an external heat exchanger to forestall the risk of overheating, thereby raising the cost and increasing the dimensions of the unit. In this case, however, it becomes necessary to limit the rated power of the motor to a certain extent so as to avoid sudden rises in temperature that can damage the motor. Accordingly, the object of the present invention is to set forth a structure for motor-compressor units that will permit of overcoming the aforementioned drawbacks.

SUMMARY OF THE INVENTION

The stated object is realized with the structure for motor-compressor units as disclosed and claimed herein.

Such a structure consists fundamentally in a casing, the inside of which affords a sealed chamber for the compressor, and a housing for the motor; according to the invention, the sealed chamber and the housing are separated by at least one bulkhead which affords fluid-tight passage to the drive shaft that interconnects the motor and compressor.

One of the advantages of the invention consists essentially in the fact that it becomes possibile to gain access to the drive motor without occasioning egress of the refrigerant fluid, since the chamber occupied by the compressor is isolated from the motor housing.

Another advantage of the invention is that of its safety, which is ensured even in the event that the motor breaks down or overheats, likewise, by virtue of the fact that the motor is isolated from the compressor.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
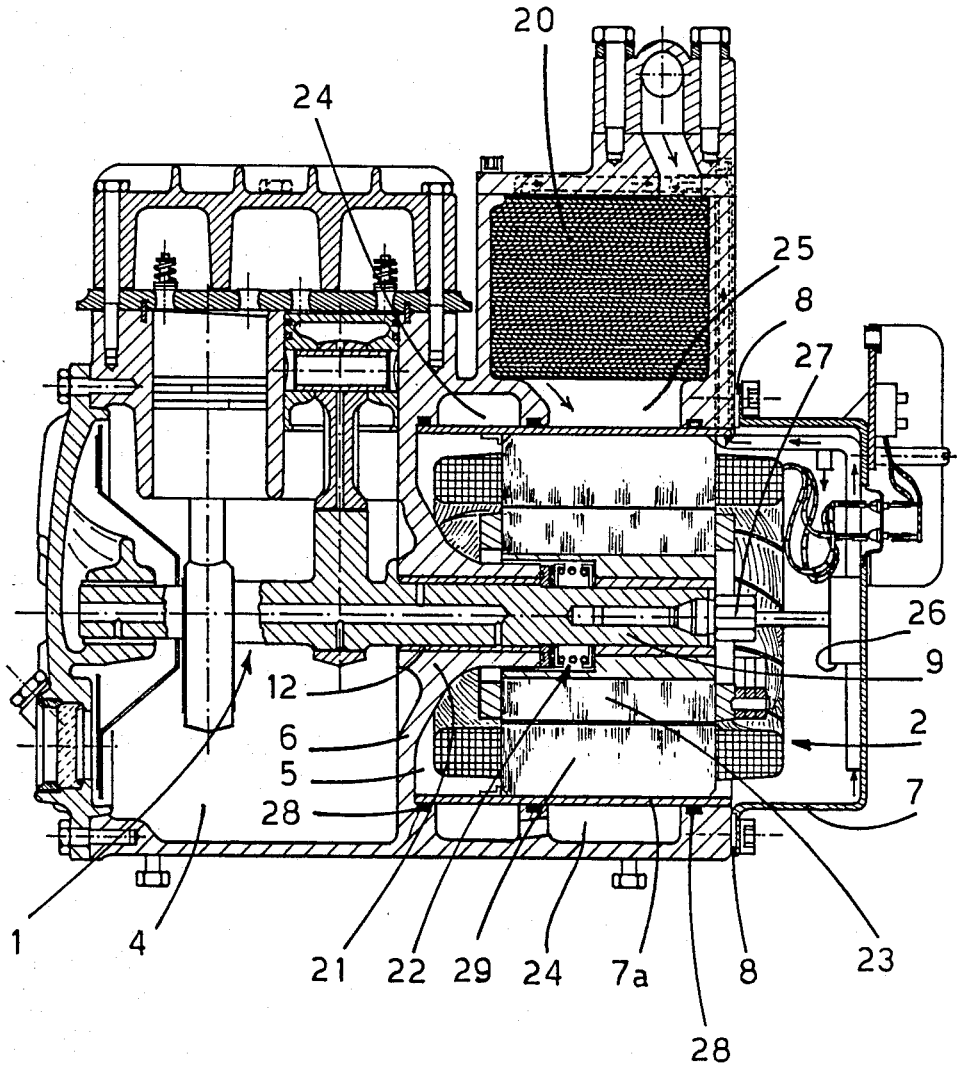
FIG. 1 shows the axial section through a motor-compressor embodied with the structure according to the invention.

With reference to the drawings, the motor-compressor unit according to the invention comprises a conventional compressor 1, a reciprocating type with pistons in the example illustrated, and a conventional motor 2, which is illustrated as an electric motor by way of example.

The compressor 1 and the motor 2 are provided with means for their mutual connection, support and encasement, which constitute the embodiment of the structure disclosed and reflect its practical and functional advantages.

According to the invention, such means comprise a substantially cylindrical casing 3 which is split by a bulkhead 6, disposed transversely in relation to the casing's longitudinal axis, into a chamber 4 for fluid-tight accommodation of the compressor 1, and a housing 5 for the motor 2.

The housing 5 (FIG. 1) is fitted with a removable base 7 located opposite the bulkhead 6 and designed, where appropriate (see FIG. 3), for rigid attachment to the motor 2.

The casing 3 affords stationary seals 8 (FIG. 1) at the points where it engages and/or makes contact with the removable base 7, which may be embodied as O-rings, for example.

The bulkhead 6 is penetrated by the shaft 9 of the compressor 1 in a fluid-tight fit, effected with sealing elements 12 of conventional embodiment.

It will be seen from FIG. 1 that the moving part 23 of the motor is keyed, rigidly and removably, to the end of the shaft 9 occupying the housing 5. In the embodiment illustrated, where the motor 2 is an electric motor, it is the rotor 23 of the motor 2 that is keyed to the shaft 9, and held in place by suitable means 27 consisting, for example, in a bolt engaging coaxially with the shaft 9.

Ensheathing the shaft 9, and located between the moving part 23 and an appendage 21 issuing from the bulkhead 6, one has a rotary shaft seal 22 designed to provide a dynamic seal between the chamber 4 and the housing 5.

Figure 2:
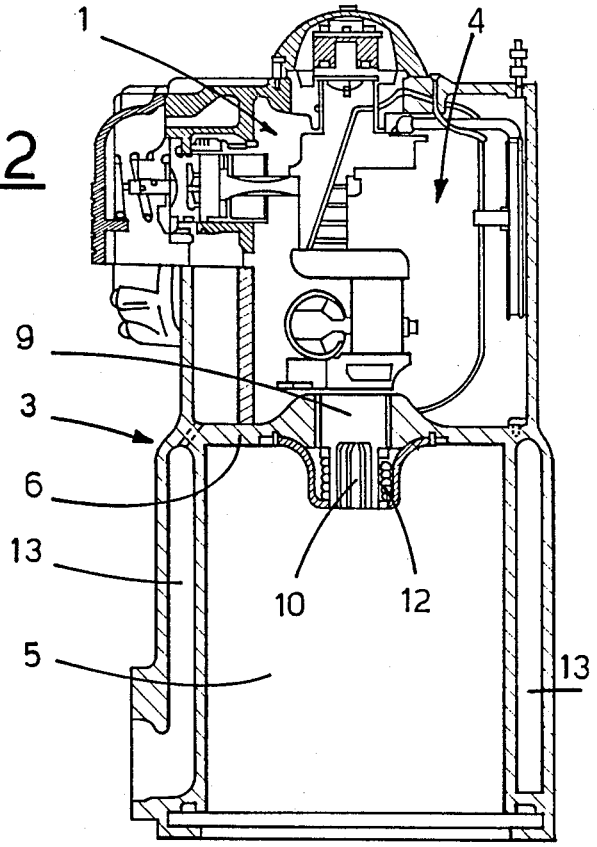
FIG. 2 shows the axial section through a compressor occupying the structure according to the invention.

In a variation of the preferred embodiment, the end of the shaft 9 directed toward or occupying the housing 5 (see FIGS. 2 and 3) incorporates a splined socket 10 for engagement by a correspondingly shaped end 11 of the shaft of the electric motor 2.

Figure 3:
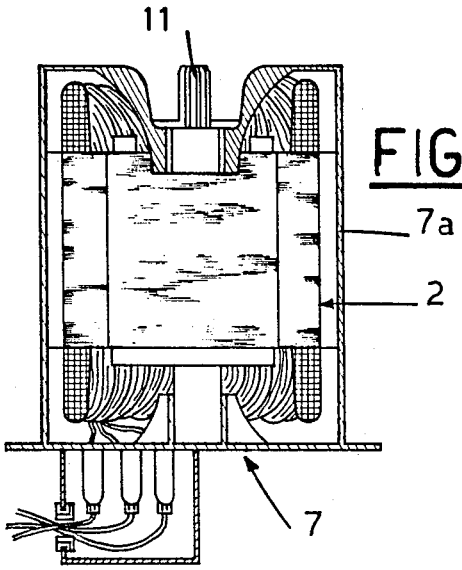
FIG. 3 is the axial section through a motor suitable for fitment to the structure of FIG. 2.

The motor 2 (see FIG. 3), or at least, its stator 29 (FIG. 1), can be rigidly accommodated to advantage internally of a hollow mounting 7*a* insertable to a fluid-tight fit in the housing 5. Greater practical advantage will be afforded by embodying the hollow mounting 7*a* in one piece with the removable base 7, as illustrated in FIG. 3.

The casing 3 is embodied to advantage with galleries 13 coinciding with the housing 5, that communicate with the inlet and outlet ports of the compressor 1 and refrigeration circuit; refrigerant can thus circulate through the galleries 13, flowing around and cooling the motor 2.

Such galleries 13 might be incorporated entirely into the casing 3 (see FIG. 2), or preferably, and in the interests of increased efficiency, embodied as peripheral seats 24 formed between the inside of the casing 3 and the hollow mounting 7*a*, which occupies the housing 5 in a fluid-tight fit created by static sealing elements 28, such as O-rings (see FIG. 1). Adopting this preferred expedient, the galleries 13 might also be fitted with non-return shut-off means (not illustrated) that will disallow the escape of refrigerant fluid from the compressor 1 in the event that the hollow mounting 7*a* also has to be removed.

During operation, the motor 2 will be cooled by the refrigerant circulating in the galleries 13, which communicate with the chamber 4, but remain isolated from the housing 5. Whichever embodiment of the galleries is adopted, in fact, the refrigerant fluid is unable to reach the housing 5 inasmuch as, in the first instance, the galleries 13 do not communicate with the housing 5 (see FIG. 2), and in the second, the peripheral seats 24 are closed off by the hollow mounting 7*a* in a static, and therefore faultlessly hermetic seals.

Heat exchange between the electric motor 2 and the refrigerant fluid can be stepped up by running the motor 2 immersed in oil, where possible as shown in FIG. 1, or in some other dielectric liquid or coolant that will favor heat exchange with the surrounding environment.

Cooling of the motor 2 can be made still more efficient by embodying the casing 3 with a compartment 25 located at one side of the housing 5, in which to accommodate a heat exchanger 20, e.g. a sheet type. The compartment 25 communicates with at least one of the galleries 13 or 24, whilst the oil or the dielectric liquid in which the motor 2 is immersed is directed through the heat exchanger 20. Thus, the refrigerant fluid from the refrigeration circuit passes over the heat exchanger 20, cooling the oil from the motor 2, then flows along the galleries 13 or 24 encircling the housing 5 to rejoin the compressor 1 for the next cycle. Where the motor 2 happens to be immersed in oil, or some other dielectric liquid or coolant, use may be made of a pump 26 to ensure its efficient circulation (see FIG. 1).

In the event of the motor 2 breaking down, it will suffice to disconnect the removable base 7 from the casing 3 to enable withdrawal of the motor 2 or, as occurs in the majority of cases, of the stator 29 with or without the rotor 23. As it is not necessary to remove the hollow mounting 7*a* for this operation, the sealing elements 12 and 28 are able to perform a faultlessly hermetic action, the shaft 9 remaining stationary for the duration of the work, with no loss of refrigerant whatever. The electric motor 2 operates in especially favorable conditions, by virtue of the cooling action of the refrigerant circulating in the galleries 13. Finally, given the ease and speed with which the motor 2 can be fitted, the motor-compressor unit can be warehoused without the motor fitted, in those cases where the ultimate operating voltage is unknown.

Such flexibility is especially advantageous for manufacturers and wholesalers of motor-compressors for refrigeration systems, and stock-related costs are considerably reduced.

It also becomes possible to fit d.c. motors or synchronous a.c. motors, or even non-electric motors such as hydraulic, pneumatic or other types; the removable base 7 can be designed and proportioned to suit any of these options.

What is claimed:

1. A structure for motor-compressor units used with refrigerant fluids comprising:

a casing;

a bulkhead, spanning the interior of the casing transversely and, with said casing, forming a chamber on one side thereof, and a motor housing on the other side thereof, wherein both said chamber and said motor housing reside within the casing, said bulkhead forming a sealed barrier between said chamber and said motor housing;

a compressor, occupying the chamber and having a shaft, the shaft of which passes thru the bulkhead in a fluid-tight fit;

a motor, mounted internally of the housing;

at least one gallery, incorporated into the casing, which is disposed peripherally in relation to the motor housing and communicates with the chamber occupied by the compressor, said gallery being sealed with respect to said motor housing; and removable coupling means serving to connect the compressor shaft with the motor and enable operation of the unit.

2. A structure for motor-compressor units used with refrigerant fluids comprising:

a casing;

a bulkhead, spanning the interior of the casing transversely and, with said casing, forming a chamber on one side thereof, and a motor housing on the other side thereof, wherein both said chamber and said motor housing are within the casing said bulkhead forming a sealed barrier between said chamber and said motor housing;

a compressor, occupying the chamber and having a shaft, the shaft of which passes thru the bulkhead in a fluid-tight fit;

a motor, mounted internally of the housing;

a compartment incorporated into said casing adjacent to the motor housing;

a heat exchanger, accommodated in said compartment and communicating therewith in such a way as to enable the passage of fluid; and removable coupling means serving to connect the compressor shaft with the motor and enable operation of the unit.

3. Motor-compressor unit structure as in claim 2, wherein the motor is coupled directly to the shaft of the compressor, ensheathing it in a fluid-tight fit.

4. Motor-compressor unit structure as in claim 2, wherein the motor housing is provided with a removable base that fastens to the casing at the end of the housing opposite from the bulkhead.

5. A structure for motor-compressor units used with refrigerant fluids, comprising:

a casing;

a bulkhead, spanning the interior of the casing transversely and, with said casing, forming a chamber on one side thereof, and a motor housing on the other side thereof, wherein both said chamber and said motor housing are within the casing said bulkhead forming a sealed barrier between said chamber and said motor housing;

a compressor, occupying the chamber and having a shaft, the shaft of which passes through the bulkhead in a fluid-tight fit;

a motor, mounted internally of the housing;

a compartment incorporated into said casing adjacent to the motor housing;

at least one gallery, incorporated into the casing which is disposed peripherally in relation to the motor housing and communicates with the chamber occupied by the compressor, said gallery being sealed with respect to said motor housing;

a heat exchanger, accommodated in a compartment that is incorporated into the casing adjacent to the motor housing and communicates therewith in such a way as to enable the passage of fluid; and removable coupling means serving to connect the compressor shaft with the motor and enable operation of the unit.

6. Motor-compressor unit structure as in claim 5, wherein the motor is coupled directly to the shaft of the compressor, ensheathing it is a fluid-tight fit.

7. Motor-compressor unit structure as in claim 5, wherein the gallery is embodied as peripheral seats created internally of the housing between the casing and the outer wall of the hollow mounting that contains the motor.

8. Motor-compressor unit structure as in claim 5, wherein the motor housing is provided with a removable base that fastens to the casing at the end of the housing opposite from the bulkhead.

9. Motor-compressor unit structure as in claim 5, wherein the heat exchanger is a sheet type.

10. Motor-compressor unit structure as in claim 5, wherein use is made of a pump, located internally of the housing, to circulate the coolant in which the motor is immersed.

* * * * *